United States Patent [19]

Unno et al.

[11] Patent Number: 4,570,387

[45] Date of Patent: Feb. 18, 1986

[54] CENTERLESS GRINDING MACHINE

[75] Inventors: Kunihiko Unno; Toshio Tsujiuchi, both of Kariya; Norio Ohta, Okazaki, all of Japan

[73] Assignee: Toyoda Koki Kabushiki Kaisha, Kariya, Japan

[21] Appl. No.: 607,213

[22] Filed: May 4, 1984

[30] Foreign Application Priority Data

May 27, 1983 [JP] Japan ..... 58-94285

[51] Int. Cl.[4] ..... B24B 49/04

[52] U.S. Cl. ..... 51/165.71; 51/103 R; 51/5 D; 51/165.87; 125/11 R

[58] Field of Search ..... 51/88, 103 R, 103 WH, 51/103 TF, 165.71, 165.87, 5 D; 125/11 R

[56] References Cited

U.S. PATENT DOCUMENTS

| | | | |
|---|---|---|---|
| 1,865,067 | 6/1932 | Warsow | 51/103 R |
| 3,665,652 | 5/1972 | Gordon | 51/165.71 |
| 3,807,098 | 4/1974 | Schaller | 51/165.71 |

FOREIGN PATENT DOCUMENTS

| | | | |
|---|---|---|---|
| 7312097 | 3/1975 | Netherlands | 51/165.71 |
| 905002 | 2/1982 | U.S.S.R. | 51/103 R |

*Primary Examiner*—Harold D. Whitehead

*Attorney, Agent, or Firm*—Oblon, Fisher, Spivak, McClelland & Maier

[57] ABSTRACT

In a centerless grinding machine, a work blade for rotatably carrying a workpiece is movable by a blade feed device in a direction normal to a first line extending across the axes of grinding and regulating wheels. Present diameters of the wheels, a desired finish diameter of the workpiece and a predetermined value representing the sine of a center height angle are stored in a data memory. The center height angle is represented by the sum of angles which a second line extending across the axes of the grinding wheel and the workpiece and a third line extending across the axes of the regulating wheel and the workpiece respectively make relative to the first line when the workpiece is finished to the desired finish diameter. When each of the wheels is dressed, a data rewriting circuit replaces the diameter of each wheel being stored in the data memory with a new diameter after such dressing. Based upon those data being stored in the data memory, a calculation circuit calculates a center height position at which the axis of the workpiece with the desired finish diameter is to be located for maintaining the center height angle constant independently of the variations in diameters of the wheels. The blade feed device positions the work blade to the calculated center height position so that the center height angle can be maintained constant.

3 Claims, 6 Drawing Figures

CENTERLESS GRINDING MACHINE

BACKGROUND OF THE INVENTION

1. Field of the Invention

The present invention relates to a centerless grinding machine of the type wherein a regulating wheel cooperates with a work blade for rotatably carrying and driving a workpiece during grinding operations.

2. Description of the Prior Art

Generally, in centerless grinding machines, the machining accuracy depends largely upon a center height angle ($\gamma$) indicated in FIG. 3. The angle ($\gamma$) amounts to the sum of angles ($\alpha$) and ($\beta$) which a line extending across the axes of a grinding wheel 11 and a workpiece W and a line extending across the axes of a regulating wheel 13 and the workpiece W respectively make with a line extending across the axes of the grinding wheel 11 and the regulating wheel 13. It is known that a high precision grinding can be realized where the center height angle ($\gamma$) is set to around seven (7) degrees. The center height angle ($\gamma$) is determined by the workpiece finish diameter, the grinding wheel diameter, the regulating wheel diameter and a center height (the distance from the workpiece axis to the line extending across the axes of the wheels in a direction normal to the line) and varies as the diameters of the wheels are decreased by dressings thereon.

In order to avoid such variation of the center height angle, it has been a common practice to effect manual adjustment of the height position of the work blade periodically in known centerless grinding machines. However, such manual adjustment requires a highly skilled operator because the adjusting amount is determined based upon the operator's experiences. Accordingly, in the known machines, it is difficult to maintain the machining accuracy of the workpieces high and particularly, to maintain the roundness of the workpieces constant and high.

Further, since the workpiece W is ground with its axis being offset normally from the line extending across the axes of the regulating wheel 13 and the grinding wheel 11 as shown in FIG. 3, the moving direction of the grinding wheel 11 is different from a direction in which the line across the grinding wheel axis and the workpiece axis extends, and likewise, the moving direction of the regulating wheel 13 is different from a direction in which the line across the regulating wheel axis and the workpiece axis extends. Thus, if the position of each of the wheels is compensated in the moving direction thereof by an amount which coincides with a decrease in radius of each wheel, a minute error in the finished workpiece dimension is cumulated each time of such dressing, whereby a precise machining accuracy cannot be maintained in a dead-stop plunge grinding mode.

In order to obviate this drawback, the positions of the grinding wheel and the regulating wheel are manually adjusted in the known centerless grinding machines each time the cumulated error attains a certain value. However, because the value of such error per dressing varies depending upon the diameters of the grinding wheel and the regulating wheel, precise compensation is difficult to perform manually. Accordingly, in the known centerless grinding machines, it is also difficult to machine workpieces precisely in the dead-stop mode.

SUMMARY OF THE INVENTION

It is therefore a primary object of the present invention to provide an improved centerless grinding machine capable of maintaining the above-noted center height angle constant regardless of the variation or decrease in diameter of a grinding wheel and a regulating wheel used therein, thereby enhancing the machining accuracy of workpieces.

Another object of the present invention is to provide an improved centerless grinding machine of the character set forth above, which is also capable of performing such positional compensations of a grinding wheel and a regulating wheel for dressings thereon so that a substantial error in the workpiece dimension can be cancelled over the whole lives of the grinding wheel and the regulating wheel.

A further object of the present invention is to provide an improved centerless grinding machine of the character set forth above, wherein the positions to which a grinding wheel and a regulating wheel are to be respectively advanced to finish a workpiece to a desired dimension after each dressing thereon are calculated by a data processor for use in controlling feed movements of the grinding wheel and the regulating wheel during subsequent grinding operations.

Briefly, according to the present invention, there is provided a centerless grinding machine comprising a work blade for rotatably carrying a workpiece in cooperation with a regulating wheel while the workpiece is ground with a grinding wheel and a blade feed mechanism for adjusting the height position of the work blade. The machine further comprises a data memory, a data rewriting circuit, a calculation circuit and a blade feed control circuit. The data rewriting circuit rewrites the grinding wheel diameter or the regulating wheel diameter being stored in the data memory each time a corresponding one of the wheels is dressed. The calculation circuit calculates a center height at which the workpiece under process is to have its axis for maintaining a center height angle constant, based upon the grinding wheel diameter, the regulating wheel diameter, a desired finish diameter of the workpiece and a predetermined center height angle which are stored in the data memory. The blade feed control circuit is responsive to the calculated center height and controls the blade feed mechanism.

With this configuration, the center height which maintains the center height angle constant is calculated in connection with the variation in diameter of the grinding wheel and the regulating wheel, and the height position of the work blade is automatically controlled based upon the calculated center height. Consequently, the center height angle can be maintained constant regardless of the variation in diameter of the wheels, whereby the workpieces can be precisely ground.

In another aspect of the present invention, another calculation circuit is further provided for calculating finish positions (X2, U2) at which advance movement of a grinding wheel carrier relative to the work blade and advance movement of a regulating wheel carrier relative to the work blade are to be respectively stopped to grind the workpiece to the desired finish diameter (d). The calculations of the finish positions (X2, U2) are effected by inserting into the following equations the diameters (Dg, Dr) of the wheels, the desired finish diameter (d) and the center height (H) which are stored in the data memory.

$$X2 = \sqrt{\left(\frac{Dg + d}{2}\right)^2 - H^2}$$

$$U2 = \sqrt{\left(\frac{Dr + d}{2}\right)^2 - H^2}$$

First and second feed contol circuits are responsive to the calculated finish positions (X2, U2) and control first and second feed mechanisms for the carriers, respectively. Because the finish positions (X2, U2) are calculated by the equations respectively based upon the actual diameters of the wheels, the finish diameters of the workpieces can be maintained to the desired dimension (d) even in the dead-stop grinding mode.

BRIEF DESCRIPTION OF THE ACCOMPANYING DRAWINGS

Various other objects, features and many of the attendant advantages of the present invention will be readily appreciated as the same becomes better understood by reference to the following detailed description of a preferred embodiment when considered in connection with the accompanying drawings, wherein like reference numerals designate identical or corresponding parts throughout the several views, and in which.

DETAILED DESCRIPTION OF A PREFERRED EMBODIMENT

Figure 1:
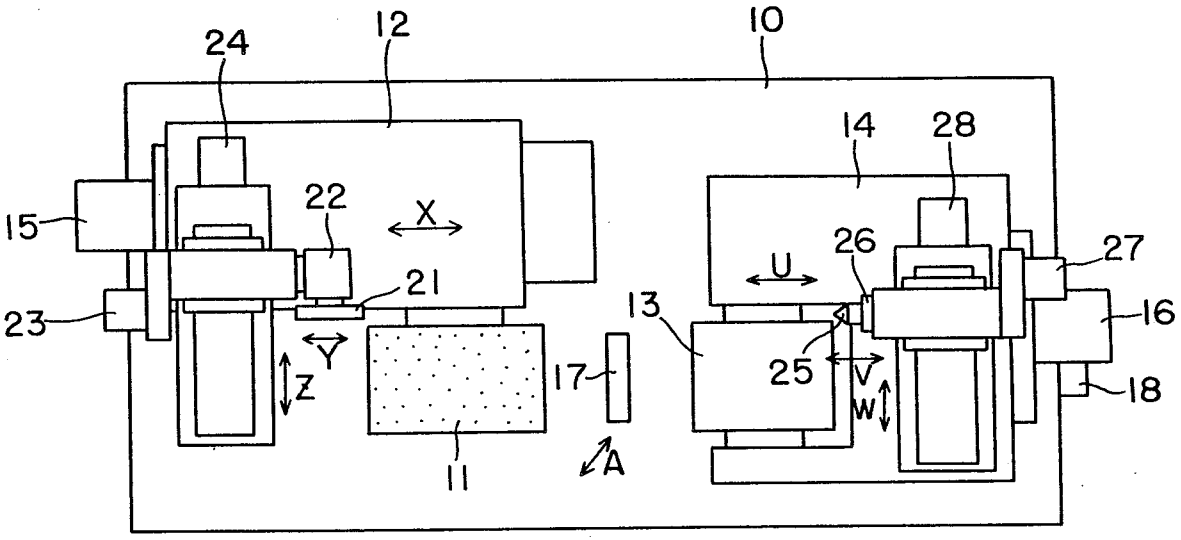
FIG. 1 is a schematic plan view of a centerless grinding machine according to the present invention.
Figure 2:
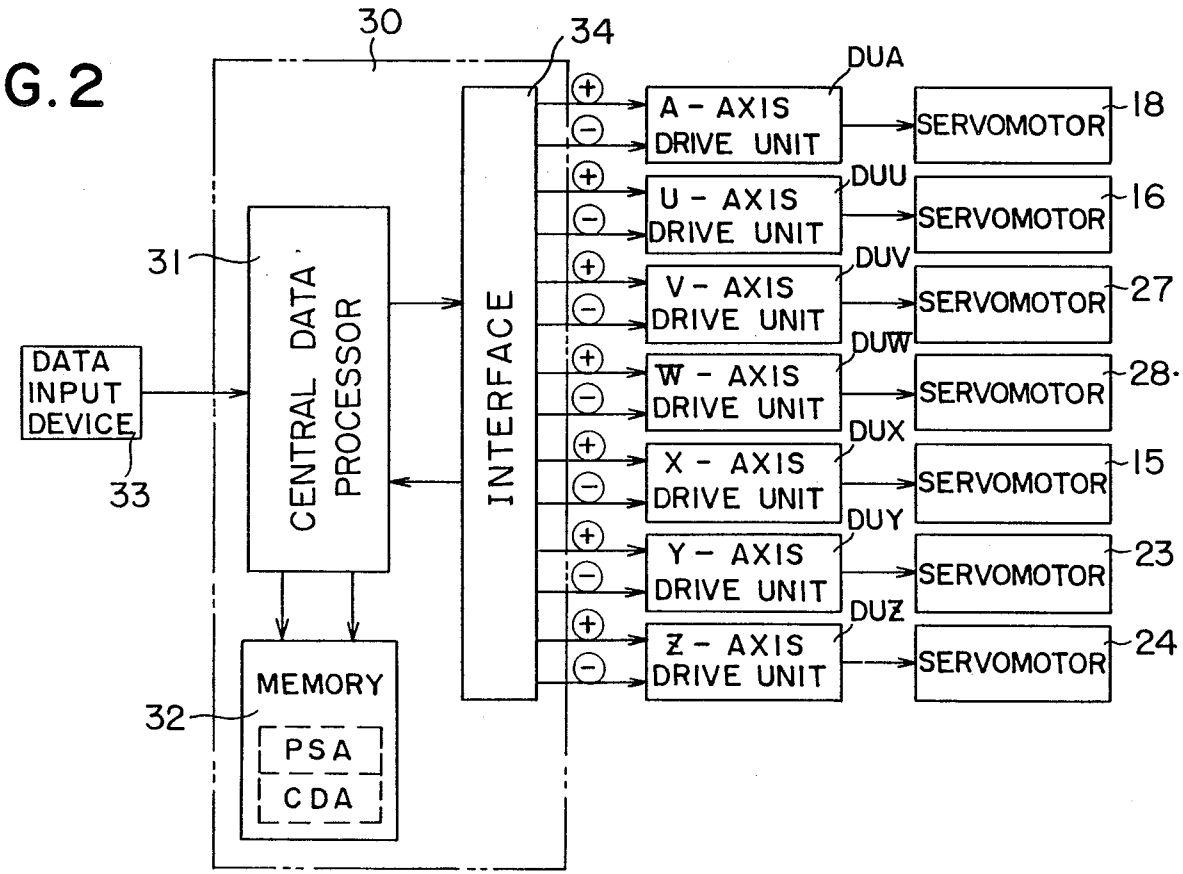
FIG. 2 is a block diagram of a control circuit for the apparatus.
Figure 3:
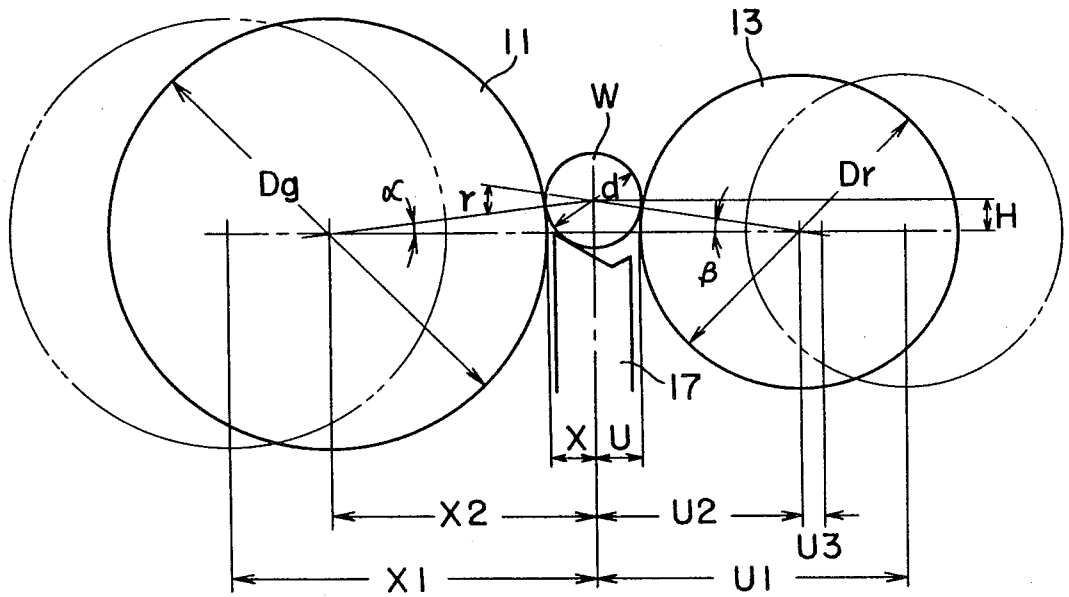
FIG. 3 is an explanatory representation illustrating the positional relationship between a grinding wheel, a regulating wheel and a work blade of the apparatus.

Referring now to the drawings and particularly to FIG. 1 thereof, reference numeral 10 denotes a bed of a numerical control centerless grinding machine, on which a wheel head 12 rotatably carrying a grinding wheel 11 and a regulating wheel support 14 rotatably carrying a regulating wheel 13 are mounted for sliding movements toward and away from each other respectively in X and U-axis directions parallel to each other. The wheel head 12 and the wheel support 14 are movable by feed devices which include servomotors 15 and 16, respectively. Between the grinding wheel 11 and the regulating wheel 13 and upon the bed 10, there is mounted a work blade 17, which is movable by a feed device including a servomotor 18, in an A-axis (vertical) direction. A workpiece W is supported by the regulating wheel 13 and the work blade 17 while being ground with the grinding wheel 11, as shown in FIG. 3.

A dressing head 22, which rotatably carries a dressing roll 21 for dressing the grinding wheel 11, is mounted on the wheel head 12 for sliding movement in a Y-axis direction transverse to the axis of the grinding wheel 11 as well as in a Z-axis direction parallel to the grinding wheel axis. An infeed device including a servomotor 23 is provided for infeeding the dressing head 22 intermittently in the Y-axis direction, while a feed device including a servomotor 24 is provided for reciprocatively moving the dressing head 22 in the Z-axis direction. Another dressing head 26, which carries a point dresser 25 for dressing the regulating wheel 13, is mounted on the regulating wheel support 14 for sliding movement in a V-axis direction transverse to the axis of the regulating wheel 13 as well as in a W-axis direction parallel to the regulating wheel axis. Feed devices including servomotors 27 and 28 are provided for infeeding the dressing head 26 in the V-axis direction and for moving the the dressing head 26 in the W-axis direction, respectively. The regulating wheel 13 is supported with its axis being slightly tilted relative to the axis of the workpiece W being supported on the work blade 17 and therefore, must be dressed to the shape of a rotated one-sheet hyperboloid. In this embodiment, the dressing of the regulating wheel 13 is done by performing a two-axis contouring control of the V and W-axes.

A control circuit for the machine will be described hereinafter with reference to FIG. 3. A central data processor 31 of a numerical controller 30 is composed of a microprocessor, which is connected to a memory 32, a data input device 33 and an interface 34. This interface 34 is in turn connected to drive units DUA, DUU, . . . and DUZ for respectively driving the servomotors 18, 16, 27, 28, 15, 23 and 24. The interface 34 is of a conventional construction and has a capability of distributing feed pulses to the drive units DUA, DUU, . . . and DUZ in response to feed amount data, feed rate data, feed direction data and so forth which are applied from the data processor 31.

The memory 32 is provided therein with a program storage area PSA storing a number of numerical control programs which are respectively used in controlling feed movements of the wheel head 12 and the wheel support 14 as well as in controlling the dressings of the grinding wheel 11 and the regulating wheel 13. Various other control data input by the data input device 33 are stored in a control data area CDA of the memory 32. The control data include data indicative of a machining start position (X1) and a machining finish position (X2) of the grinding wheel 11, data indicative of a machining start position (U1), a machining finish position (U2) and an infeed stroke (U3) of the regulating wheel 13, data indicative of a present position (A1) of the work blade 17, and data indicative of a desired finish diameter (d) of the workpiece W, as indicated in FIG. 3 except for the blade present position (A1). Although not shown, the control data further include data representing an infeed amount (L1) and a traverse feed amount (L2) of the dressing roll 21, data representing an infeed amount (L3) and a traverse feed amount (L4) of the point dresser 25, data representing the grinding wheel diameter (Dg) and the regulating wheel diameter (Dr), data representing a center height (H) and data representing the sine of a center height angle ($\gamma$).

Figure 4:
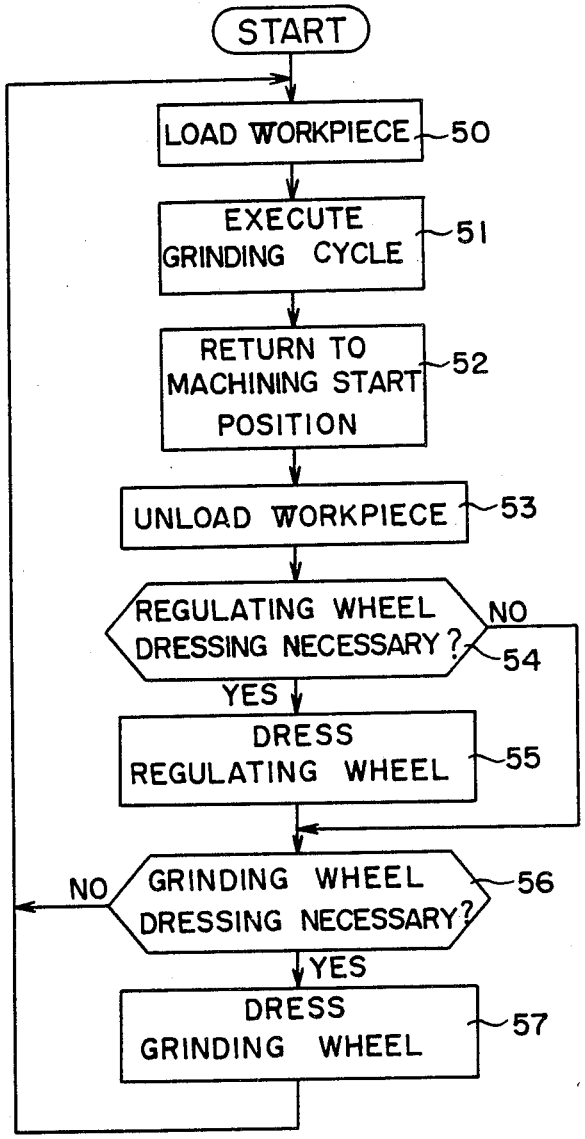
FIG. 4 is a flow chart of an automatic operation cycle routine executed by a data processor shown in FIG. 2.

FIG. 4 shows a flow chart for an automatic operation cycle. When the automatic operation is started, the workpiece W is loaded by a suitable loading/unloading device (not shown) onto the work blade 17 in step 50. In the automatic grinding cycle performed in step 51, the wheel head 12 is advanced a distance (i.e., X1-X2) from the machining start position (X1) at a rapid feed rate to be positioned to the finish position (X2). At the same time, the regulating wheel support 14 is advanced another distance (i.e., U1-U2-U3) from the machining start position (U1) at a rapid feed rate. The regulating wheel support 14 is then infed the amount (U3) and reaches the finish position (U2), whereby the workpiece W is ground to the desired finish diameter (d) in dead-stop mode. The finish position data (X2, U2) being stored in the memory 32 are used to stop the grinding and regulating wheels 11 and 13 respectively at the finish positions (X2, U2). After the grinding wheel head 12 and the regulating wheel support 14 are subsequently retracted to the respective machining start positions (X1, U1) in step 52, the workpiece W is unloaded by the suitable loading/unloading device from the work blade 17 in step 53.

It is then ascertained in step 54 whether the dressing of the regulating wheel 13 is necessary or not, and if unnecessary, it is further ascertained in step 56 whether the dressing of the grinding wheel 11 is necessary or not. If the grinding wheel dressing is also unnecessary, another workpiece W of the same kind is loaded on the work blade 17 in step 50, whereafter the foregoing operations as performed in steps 52–53 are repeated. However, if the regulating wheel dressing is ascertained to be necessary this time in step 54, a regulating wheel dressing cycle is performed in step 55 as referred to later, whereas if the grinding wheel dressing is ascertained to be necessary in step 56, a grinding wheel dressing cycle is performed in step 57 as referred to later.

Such dressings on the grinding wheel 11 and the regulating wheel 13 cause their wheel diameters to decrease, which in turn cuases the center height angle ($\gamma$) to change. Routines executed by the data processor 31 for maintaining the center height angle ($\gamma$) constant irrespective of decreases in the diameters of the wheels 11 and 13 will be described hereinafter with reference to flow charts shown in FIGS. 5 and 6. It is to be noted herein that one or two dressing operations on the grinding wheel 11 do not cuase a substantial change in the center height angle ($\gamma$). Therefore, in this particular embodiment, the adjustment of the center height (H) is performed each time the regulating wheel 13 is dressed, as described later in detail.

Figure 5:
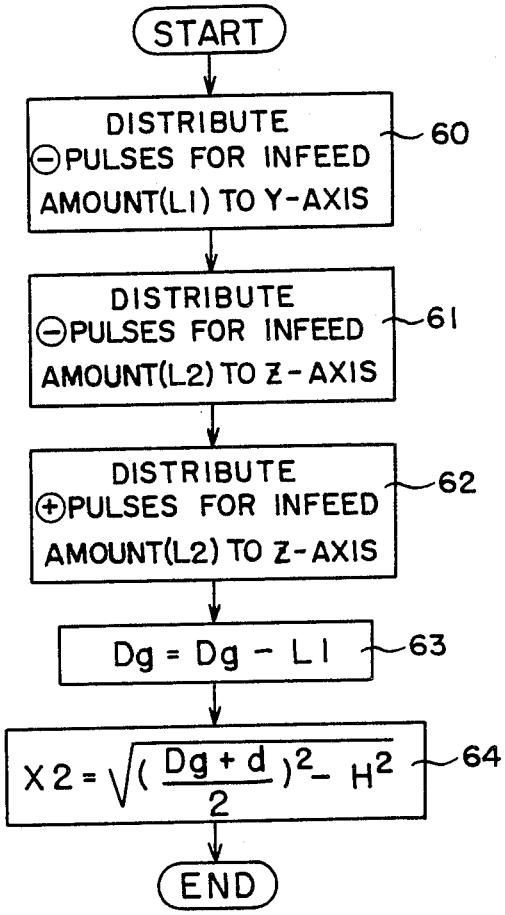
FIG. 5 is a flow chart of a grinding wheel dressing routine executed by the data processor.

Referring now to FIG. 5, when the dressing of the grinding wheel 11 is instructed, step 60 is executed, wherein pulses of the number corresponding to an infeed amount (L1) are distributed to the Y-axis drive unit DUY so as to infeed dressing roll 21 by the predetermined amount (L1). Subsequently, negative-going pulses of the number corresponding to the traverse feed amount (L2) are distributed to the Z-axis drive unit DUZ in step 61, and positive-going pulses of the number corresponding to the traverse feed amount (L2) are distributed to the Z-axis drive unit DUZ in step 62. This results in effecting one reciprocative movement of the dressing roll 21 in the Z-axis direction, whereby the grinding wheel 11 is dressed. In step 63, the grinding wheel diameter data (Dg) being stored in the memory 32 is reduced by the dressing wear amount of the grinding wheel 11, namely by the above-noted infeed amount (L1), and the resultant grinding wheel diameter data (Dg) is again stored in a storage address of the memory 32 where it was. Further, the position of the wheel head 12 which is compensated for the decrease in diameter of the grinding wheel 12 is calculated in step 64. In this case, because the feed direction of the wheel head 12 is different from the direction in which the line across the axes of the grinding wheel 11 and the workpiece W extends, a new finish position (X2) of the grinding wheel 11 is calculated using the following equation. That is, such calculation is done by inserting into the equation the grinding wheel diameter (Dg), the workpiece finish diameter (d) and the center height (H) which are stored in the memory 32.

$$X2 = \sqrt{\left(\frac{Dg + d}{2}\right)^2 - H^2}$$

The finish position (X2) so calculated is replaced with the corresponding old data being stored in the memory 32 for use in subsequent grinding operations, and the grinding wheel dressing routine is thus completed.

Consequently, when the grinding operation is subsequently carried out in the above-noted step 51, the rapid feed amount of the grinding wheel 11 from the machining start position (X1) is changed to adjust the finish position (X2) of the wheel head 12. This brings about the same result as adjusting the position of the wheel head 12 by the decreased amount (L1) of the grinding wheel 11 in the direction extending across the axes of the grinding wheel 11 and the workpiece W, so that no error is involved in positional compensation.

Figure 6:
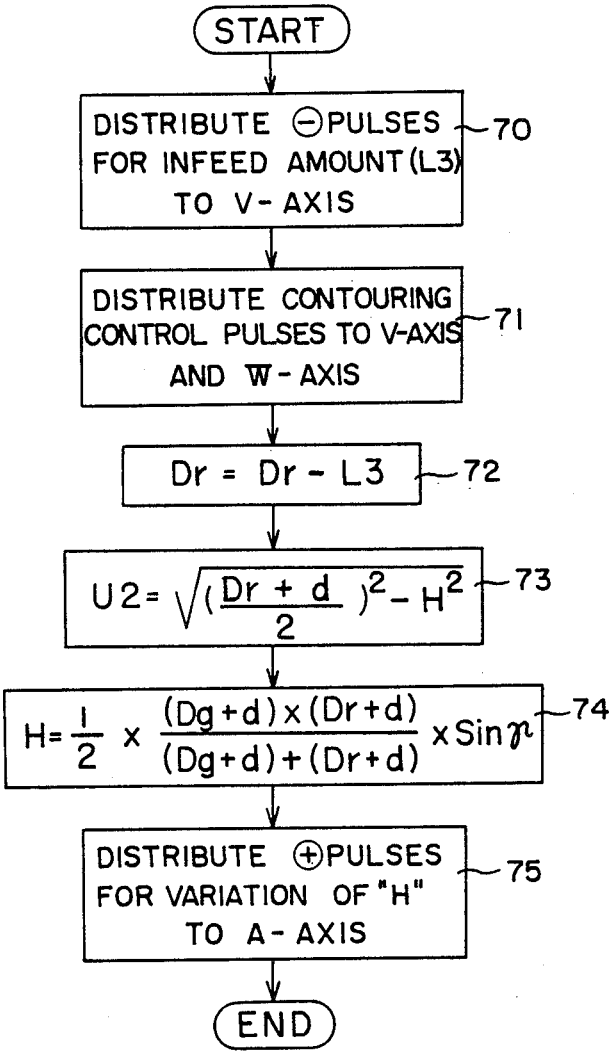
FIG. 6 is a flow chart of a regulating wheel dressing routine executed by the data processor.

Furthermore, when the dressing of the regulating wheel 13 is ascertained to be necessary in step 54 of FIG. 4, the routine shown in FIG. 6 is executed, wherein pulses of the number corresponding to an infeed amount (L3) is distributed to the V-axis drive unit DUV in step 70 so as to infeed the point dresser 25 by the predetermined amount (L3) against the regulating wheel 13. In step 71, a two-axis contouring control is performed to simultaneously distribute pulses to the W-axis drive unit DUW and the V-axis drive unit DUV, whereby the regulating wheel 13 is shaped to a rotated one-sheet hyperboloid. In step 72, the regulating wheel diameter data (Dr) being stored in the memory 32 is subtracted by the double of the dressing infeed amount (L3), and the resultant diameter data (Dr) is again stored at a storage address where the old data (Dr) was. Step 73 is then executed to calculate the finish position (U2) of the regulating wheel support 14 in connection with a decrease in diameter of the regulating wheel 13. This calculation is performed by inserting into the following equation the regulating wheel diameter (Dr), the workpiece finish diameter (d), and the center height (H) being stored in the memory 32, and the calculated finish position (U2) is replaced with the corresponding old data (H) being stored in the memory 32.

$$U2 = \sqrt{\left(\frac{Dr + d}{2}\right)^2 - H^2}$$

In order that the center height angle ($\gamma$) can be maintained constant independently of the variations in diameters of the grinding and regulating wheels 11 and 13 caused by dressings thereon, a new center height (H) is calculated based upon the actual diameters of the wheels 11 and 13 in step 74, and the work blade 17 is moved to the position designated by the calculated center height (H) in step 75. Specifically, the wheel diameters (Dg, Dr), the workpiece finish diameter (d) and a predetermined value indicating the sine of the center height angle ($\gamma$) which are stored in the memory 32 are inserted into the following equation so as to obtain the new center height (H).

$$H = \frac{1}{2} \times \frac{(Dg + d) \times (Dr + d)}{(Dg + d) + (Dr + d)} \times \text{Sin}\gamma$$

The difference between the new center height (H) and the present center height (H) of the work blade 17 is calculated, and pulses of the number corresponding to the difference are distributed to the A-axis drive unit DUA. Consequently, the work blade 17 is lowered by the difference, whereby the center height angle ($\gamma$) can be maintained constant.

Although the above-described particular embodiment exemplifies a centerless grinding machine of the construction that each of the wheel head 12 and the regulating wheel support 14 is moved toward and away from the work blade 17, the present invention may be applied to a centerless grinding machine of another construction that for example, each of a work blade and a regulating wheel support is moved toward and away from a grinding wheel head fixedly provided. In this case, the finish position (X2) of the grinding wheel may be controlled by advancing the work blade toward the grinding wheel head, whereas the finish position (U2) of the regulating wheel may be controlled by advancing the regulating wheel support toward the work blade.

The timing when the center height (H) is adjusted is not limited to the same timing as the regulating wheel 13 is dressed, as described in the embodiment. Rather, such timing may be freely determined taking the required workpiece accuracy into consideration.

Further, in the above-described embodiment, data representing the finish positions (X2, U2) of the grinding and regulating wheels 11 and 13 are renewed or rewritten in correspondence to decreases in the wheel diameters (Dg, Dr) caused by dressings, and the finish positions (X2, U2) are adjusted by varying infeed amounts of the wheels 11 and 13 during the machining of the workpiece W. However, each of such infeed amounts may be maintained constant by compensating the machining start positions (X1, U1) of the wheels 11 and 13 respectively for the differences between new finish positions (X2, U2) and previous finish positions (X2, U2) prior to the first grinding operation performed thereafter.

Obviously, numerous modifications and variations are possible in light of the above teachings. It is therefore to be understood that within the scope of the appended claims, the present invention may be practiced otherwise than as specifically described herein.

What is claimed as new and desired to be secured by Letters Patent of the United States is:

1. In a centerless grinding machine having first and second supports mounted on a bed and respectively rotatably carrying a grinding wheel and a regulating wheel, a work blade mounted on said bed between said grinding and regulating wheels for rotatably supporting a workpiece in cooperation with said regulating wheel during a machining operation of said workpiece, a first feed device for moving said work blade in a direction transverse to a first line extending across the axes of said grinding and regulating wheels, and first and second dressing means for respectively dressing said grinding and regulating wheels, the improvement comprising:

a data memory for storing diameters of said grinding and regulating wheels, a desired finish diameter of said workpiece and a predetermined value representing the sine of a center height angle, said center height angle amounting to the sum of angles which a second line extending across the axes of said grinding wheel and said workpiece and a third line extending across the axes of said regulating wheel and said workpiece respectively make relative to said first line when said workpiece is finished to said desired finish diameter;

data rewriting means for rewriting said grinding and regulating wheel diameters being stored in said data memory respective when said grinding wheel and said regulating wheel are dressed by said first and second dressing means, so as to make the rewritten diameter data respectively represent the actual diameters of said grinding and regulating wheels;

first calculation means for calculating a center height based upon said grinding and regulating wheel diameters, said desired finish diameter and said predetermined value being stored in said data memory, said center height defining a position at which the axis of said workpiece with said desired finish diameter is to be located for maintaining said center height angle constant independently of decreases in diameters of said grinding and regulating wheels; and first feed control means connected to said first feed device for controlling the same based upon said calculated center height so that said center height angle is maintained constant.

2. A centerless grinding machine as set forth in claim 1, wherein said first calculation means calculates said center height (H) by inserting into the following equation said grinding and regulating wheel diameters (Dg, Dr), said desired finish diameter (d) and said predetermined value representing the sine of said center height angle ($\gamma$).

$$H = \frac{1}{2} \times \frac{(Dg + d) \times (Dr + d)}{(Dg + d) + (Dr + d)} \times \text{Sin}\gamma$$

3. A centerless grinding machine as set forth in claim 2, further comprising:

second and third feed devices for respectively effecting relative movement between said first support and said work blade and relative movement between said second support and said work blade in a direction in which said first line extends;

second calculation means for calculating finish positions (X2, U2) of said first and second supports by inserting into the following equations $$X2 = \sqrt{\left(\frac{Dg + d}{2}\right)^2 - H^2}$$

$$U2 = \sqrt{\left(\frac{Dr + d}{2}\right)^2 - H^2}$$

said grinding and regulating wheel diameters (Dg, Dr), said desired finish diameter (d) and said center height (H) calculated by said first calculation means; and second feed control means connected to said second and third feed devices for controlling advanced positions of said first and second supports relative to said work blade respectively to said finish positions (X2, U2) calculated by said second calculation means.

* * * * *